US009845642B2

(12) United States Patent
Stockey

(10) Patent No.: US 9,845,642 B2
(45) Date of Patent: Dec. 19, 2017

(54) CUTTING ELEMENTS HAVING NON-PLANAR CUTTING FACES WITH SELECTIVELY LEACHED REGIONS, EARTH-BORING TOOLS INCLUDING SUCH CUTTING ELEMENTS, AND RELATED METHODS

(71) Applicant: Baker Hughes Incorporated, Houston, TX (US)

(72) Inventor: David A. Stockey, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 642 days.

(21) Appl. No.: 14/215,786

(22) Filed: Mar. 17, 2014

(65) Prior Publication Data

US 2015/0259986 A1 Sep. 17, 2015

(51) Int. Cl.
*E21B 10/42* (2006.01)
*E21B 10/55* (2006.01)
(Continued)

(52) U.S. Cl.
CPC ..... *E21B 10/55* (2013.01); *B24D 3/005* (2013.01); *B24D 3/10* (2013.01); *B24D 18/0009* (2013.01); *E21B 10/42* (2013.01)

(58) Field of Classification Search
CPC ..... E21B 10/55; E21B 10/5735; E21B 10/42; E21B 10/5676; E21B 10/5673; B24D 18/0009; B24D 3/10; B24D 3/005
See application file for complete search history.

(56) References Cited

U.S. PATENT DOCUMENTS 4,224,380 A 9/1980 Bovenkerk et al.
5,011,515 A 4/1991 Frushour
(Continued)

FOREIGN PATENT DOCUMENTS

AU 2005243867 A1 11/2005
CA 2566597 A1 11/2005
(Continued)

OTHER PUBLICATIONS

International Search Report for PCT/US2015/020393, dated Sep. 30, 2015, 4 pages.
(Continued)

*Primary Examiner* — Daniel P Stephenson
(74) *Attorney, Agent, or Firm* — TraskBritt

(57) ABSTRACT

A cutting element may include a substrate and a volume of polycrystalline diamond material affixed to the substrate at an interface. The volume of polycrystalline diamond may include a front cutting face with at least one substantially planar portion and at least one recess. The at least one recess may extend from a plane defined by the at least one substantially planar portion a first depth into the volume of polycrystalline diamond material in an axial direction parallel to a central axis of the cutting element. The volume of polycrystalline diamond material may comprise a region including a catalyst material. At least one region substantially free of the catalyst material may extend from the at least one substantially planar portion of the front cutting face a second depth into the volume of polycrystalline diamond in the axial direction. Methods of forming cutting elements.

17 Claims, 5 Drawing Sheets

(51) Int. Cl.

| | |
|---|---|
| ***B24D 18/00*** | (2006.01) |
| ***B24D 3/00*** | (2006.01) |
| ***B24D 3/10*** | (2006.01) |

(56) References Cited

U.S. PATENT DOCUMENTS

| | | | | |
|---|---|---|---|---|
| 5,127,923 | A | 7/1992 | Bunting et al. | |
| 5,172,778 | A | 12/1992 | Tibbitts | |
| 5,472,376 | A | 12/1995 | Olmstead et al. | |
| 5,605,198 | A | 2/1997 | Tibbitts et al. | |
| 5,669,271 | A | 9/1997 | Griffin et al. | |
| 5,709,279 | A | 1/1998 | Dennis | |
| 5,711,702 | A | 1/1998 | Devlin | |
| 5,787,022 | A | 7/1998 | Tibbitts et al. | |
| 5,829,541 | A | 11/1998 | Flood et al. | |
| 5,862,873 | A | 1/1999 | Matthias et al. | |
| 5,906,246 | A | 5/1999 | Mensa et al. | |
| 5,950,747 | A | 9/1999 | Tibbitts et al. | |
| 6,011,232 | A | 1/2000 | Matthias | |
| 6,021,859 | A | 2/2000 | Tibbitts et al. | |
| 6,045,440 | A * | 4/2000 | Johnson | E21B 10/5673 175/432 |
| 6,193,001 | B1 | 2/2001 | Eyre et al. | |
| 6,202,772 | B1 | 3/2001 | Eyre et al. | |
| 6,601,662 | B2 | 8/2003 | Matthias et al. | |
| 6,991,049 | B2 | 1/2006 | Eyre et al. | |
| 7,165,636 | B2 | 1/2007 | Eyre et al. | |
| 7,533,740 | B2 | 5/2009 | Zhang | |
| 7,712,553 | B2 | 5/2010 | Shamburger | |
| 8,172,012 | B2 | 5/2012 | Achilles | |
| 8,197,936 | B2 | 6/2012 | Keshavan | |
| 8,277,722 | B2 | 10/2012 | DiGiovanni | |
| 8,353,371 | B2 | 1/2013 | Cooley et al. | |
| 8,535,400 | B2 | 9/2013 | Belnap et al. | |
| 8,567,531 | B2 | 10/2013 | Belnap et al. | |
| 8,721,752 | B2 | 5/2014 | Fuller et al. | |
| 8,764,864 | B1 | 7/2014 | Miess et al. | |
| 8,783,389 | B2 | 7/2014 | Fan et al. | |
| 8,800,692 | B2 | 8/2014 | Scott et al. | |
| 8,821,604 | B2 | 9/2014 | Sani | |
| 8,839,889 | B2 | 9/2014 | DiGiovanni et al. | |
| 8,899,358 | B2 | 12/2014 | Yu et al. | |
| 8,978,789 | B1 | 3/2015 | Sani et al. | |
| 8,985,248 | B2 | 3/2015 | DiGiovanni et al. | |
| 8,999,025 | B1 | 4/2015 | Miess et al. | |
| 9,103,172 | B1 | 8/2015 | Bertagnolli et al. | |
| 9,316,059 | B1 * | 4/2016 | Topham | E21B 10/62 |
| 2001/0003932 | A1 | 6/2001 | Packer | |
| 2002/0071729 | A1 | 6/2002 | Middlemiss et al. | |
| 2002/0074168 | A1 | 6/2002 | Matthias et al. | |
| 2002/0079140 | A1 | 6/2002 | Eyre et al. | |
| 2003/0037964 | A1 | 2/2003 | Sinor et al. | |
| 2003/0079918 | A1 | 5/2003 | Eyre et al. | |
| 2006/0165993 | A1 | 7/2006 | Keshavan | |
| 2007/0039762 | A1 | 2/2007 | Achilles | |
| 2007/0144790 | A1 * | 6/2007 | Fang | C01B 31/06 175/434 |
| 2008/0206576 | A1 | 8/2008 | Qian et al. | |
| 2009/0022952 | A1 | 1/2009 | Keshavan | |
| 2010/0012389 | A1 | 1/2010 | Zhang et al. | |
| 2010/0186304 | A1 | 7/2010 | Burgess et al. | |
| 2010/0236837 | A1 | 9/2010 | Achilles | |
| 2010/0242375 | A1 * | 9/2010 | Hall | B22F 3/14 51/307 |
| 2010/0288564 | A1 * | 11/2010 | Dovalina, Jr. | E21B 10/5676 175/428 |
| 2010/0320006 | A1 | 12/2010 | Fan et al. | |
| 2011/0042149 | A1 | 2/2011 | Scott et al. | |
| 2011/0088950 | A1 | 4/2011 | Scott et al. | |
| 2011/0120782 | A1 | 5/2011 | Cooley et al. | |
| 2011/0171414 | A1 | 7/2011 | Sreshta et al. | |
| 2011/0174549 | A1 * | 7/2011 | Dolan | E21B 10/5676 175/428 |
| 2011/0212303 | A1 | 9/2011 | Fuller et al. | |
| 2011/0259642 | A1 | 10/2011 | DiGiovanni et al. | |
| 2011/0259648 | A1 | 10/2011 | Sani | |
| 2011/0266059 | A1 | 11/2011 | DiGiovanni et al. | |
| 2012/0037431 | A1 | 2/2012 | DiGiovanni et al. | |
| 2012/0080239 | A1 | 4/2012 | Lyons et al. | |
| 2012/0097457 | A1 | 4/2012 | Setlur et al. | |
| 2012/0103700 | A1 | 5/2012 | Lin | |
| 2012/0222363 | A1 | 9/2012 | DiGiovanni et al. | |
| 2012/0222364 | A1 | 9/2012 | Lyons et al. | |
| 2012/0225277 | A1 | 9/2012 | Scott | |
| 2013/0068534 | A1 | 3/2013 | DiGiovanni et al. | |
| 2013/0068537 | A1 | 3/2013 | DiGiovanni | |
| 2013/0068538 | A1 | 3/2013 | DiGiovanni et al. | |
| 2013/0092454 | A1 | 4/2013 | Scott et al. | |
| 2013/0292184 | A1 | 11/2013 | Weaver | |
| 2014/0060937 | A1 | 3/2014 | Konovalov et al. | |
| 2014/0069726 | A1 | 3/2014 | Mumma et al. | |
| 2014/0134403 | A1 | 5/2014 | Gledhill | |
| 2014/0166371 | A1 | 6/2014 | Whittaker | |
| 2015/0021100 | A1 | 1/2015 | Cheng | |
| 2015/0129321 | A1 | 5/2015 | Sani | |
| 2015/0259986 | A1 * | 9/2015 | Stockey | E21B 10/55 175/434 |
| 2015/0266163 | A1 * | 9/2015 | Stockey | B24D 18/0009 51/309 |
| 2016/0002982 | A1 * | 1/2016 | Mukhopadhyay | B22F 3/14 175/428 |
| 2016/0230471 | A1 * | 8/2016 | Gonzalez | E21B 10/5673 |
| 2016/0318808 | A1 * | 11/2016 | Kasonde | B22F 7/06 |
| 2016/0325404 | A1 * | 11/2016 | Long | B24D 18/0009 |
| 2016/0326809 | A1 * | 11/2016 | Long | E21B 10/567 |
| 2016/0339561 | A1 * | 11/2016 | Vail | B24D 3/10 |

FOREIGN PATENT DOCUMENTS

| | | | |
|---|---|---|---|
| CA | 2566597 | C | 11/2011 |
| EP | 1750876 | B1 | 7/2011 |
| WO | 2005110648 | A2 | 11/2005 |
| WO | 2009024752 | A2 | 2/2009 |
| WO | 2012145586 | A1 | 10/2012 |

OTHER PUBLICATIONS

Written Opinion of the International Searching Authority for PCT/US2015/020393, dated Jun. 23, 2015, 10 pages.

Scott et al., U.S. Appl. No. 13/783,118, entitled Cutting Elements Leached to Different Depths Located in Different Regions of an Earth-Boring Tool and Related Methods, filed Mar. 1, 2013.

Underwood, Ervin E., Quantitative Stereology, Addison-Wesley Publishing Company, Inc., 1970, 20 pages.

Cheng, U.S. Appl. No. 13/947,723, entitled Thermally Stable Polycrystalline Compacts for Reduced Spalling Earth-Boring Tools Including Such Compacts, and Related Methods, filed Jul. 22, 2013.

DiGiovanni et al., U.S. Appl. No. 14/248,008, entitled Cutting Elements Having a Non-Uniform Annulus Leach Depth, Earth-Boring Tools Including Such Cutting Elements, and Related Methods, filed Apr. 8, 2014.

Stockey et al., U.S. Appl. No. 14/248,068, entitled Cutting Elements Including Undulating Boundaries Between Catalyst-Containing and Catalyst-Free Regions of Polycrystalline Superabrasive Materials and Related Earth-Boring Tools and Methods, filed Apr. 8, 2014.

Stockey et al., U.S. Appl. No. 14/329,380, entitled Cutting Elements Comprising Partially Leached Polycrystalline Material, Tools Comprising Such Cutting Elements, and Methods of Forming Wellbores Using Such Cutting Elements, filed Jul. 11, 2014.

* cited by examiner

CUTTING ELEMENTS HAVING NON-PLANAR CUTTING FACES WITH SELECTIVELY LEACHED REGIONS, EARTH-BORING TOOLS INCLUDING SUCH CUTTING ELEMENTS, AND RELATED METHODS

TECHNICAL FIELD

Embodiments of the present disclosure relate to polycrystalline diamond compact (PDC) cutting elements for use in earth-boring tools having one or more regions in which metal solvent catalyst is present within interstitial spaces between diamond grains in the polycrystalline diamond, and one or more regions in which no metal solvent catalyst is present between diamond grains in the polycrystalline diamond.

BACKGROUND

Earth-boring tools for forming wellbores in subterranean earth formations generally include a plurality of cutting elements secured to a body. For example, fixed cutter earth-boring rotary drill bits (also referred to as "drag bits") include a plurality of cutting elements that are fixedly attached to a bit body of the drill bit. Similarly, roller cone earth-boring rotary drill bits include cones that are mounted on bearing pins extending from legs of a bit body such that each cone is capable of rotating about the bearing pin on which it is mounted. A plurality of cutting elements may be mounted to or otherwise provided on each cone of the drill bit.

The cutting elements used in such earth-boring tools often include polycrystalline diamond compact (often referred to as "PDC") cutting elements, which are cutting elements that include cutting faces of a polycrystalline diamond material. Polycrystalline diamond material is material that includes inter-bonded grains or crystals of diamond. In other words, polycrystalline diamond material includes direct, inter-granular bonds between the grains or crystals of diamond. The terms "grain" and "crystal" are used synonymously and interchangeably herein.

Polycrystalline diamond compact cutting elements are formed by sintering and bonding together relatively small diamond grains under conditions of high temperature and high pressure in the presence of a catalyst (such as, for example, cobalt, iron, nickel, or alloys and mixtures thereof) to form a layer or "table" of polycrystalline diamond material on a cutting element substrate. These processes are often referred to as high temperature/high pressure (or "HTHP") processes. The cutting element substrate may comprise a cermet material (i.e., a ceramic metal composite material) such as, for example, cobalt cemented tungsten carbide. In such instances, the cobalt (or other catalyst material) in the cutting element substrate may be swept into the diamond grains during sintering and serve as the catalyst material for forming the inter-granular diamond-to-diamond bonds between, and the resulting diamond table from, the diamond grains. In other methods, powdered catalyst material may be mixed with the diamond grains prior to sintering the grains together in a HTHP process.

Upon formation of a diamond table using a HTHP process, catalyst material may remain in interstitial spaces between the grains of diamond in the resulting polycrystalline diamond table. The presence of the catalyst material in the diamond table may contribute to thermal damage in the diamond table when the cutting element is heated during use, due to friction at the contact point between the cutting element and the formation.

Polycrystalline diamond compact cutting elements in which the catalyst material remains in the diamond table are generally thermally stable up to a temperature of about seven hundred and fifty degrees Celsius (750° C.), although internal stress within the cutting element may begin to develop at temperatures exceeding about four hundred degrees Celsius (400° C.) due to a phase change that occurs in cobalt at that temperature (a change from the "beta" phase to the "alpha" phase). Also beginning at about four hundred degrees Celsius (400° C.), there is an internal stress component that arises due to differences in the thermal expansion of the diamond grains and the catalyst metal at the grain boundaries. This difference in thermal expansion may result in relatively large tensile stresses at the interface between the diamond grains, and contributes to thermal degradation of the microstructure when polycrystalline diamond compact cutting elements are used in service. Differences in the thermal expansion between the diamond table and the cutting element substrate to which it is bonded further exacerbate the stresses in the polycrystalline diamond compact. This differential in thermal expansion may result in relatively large compressive and/or tensile stresses at the interface between the diamond table and the substrate that eventually lead to the deterioration of the diamond table, cause the diamond table to delaminate from the substrate, or result in the general ineffectiveness of the cutting element.

Furthermore, at temperatures at or above about seven hundred and fifty degrees Celsius (750° C.), some of the diamond crystals within the diamond table may react with the catalyst material causing the diamond crystals to undergo a chemical breakdown or conversion to another allotrope of carbon. For example, the diamond crystals may graphitize at the diamond crystal boundaries, which may substantially weaken the diamond table. Also, at extremely high temperatures, in addition to graphite, some of the diamond crystals may be converted to carbon monoxide and carbon dioxide.

In order to reduce the problems associated with differences in thermal expansion and chemical breakdown of the diamond crystals in polycrystalline diamond cutting elements, so called "thermally stable" polycrystalline diamond compacts (which are also known as thermally stable products, or "TSPs") have been developed. Such a thermally stable polycrystalline diamond compact may be formed by leaching the catalyst material (e.g., cobalt) out from interstitial spaces between the inter bonded diamond crystals in the diamond table using, for example, an acid or combination of acids (e.g., aqua regia). A substantial amount of the catalyst material may be removed from the diamond table, or catalyst material may be removed from only a portion thereof. Thermally stable polycrystalline diamond compacts in which substantially all catalyst material has been leached out from the diamond table have been reported to be thermally stable up to temperatures of about twelve hundred degrees Celsius (1,200° C.). It has also been reported, however, that such fully leached diamond tables are relatively more brittle and vulnerable to shear, compressive, and tensile stresses than are non-leached diamond tables. In addition, it is difficult to secure a completely leached diamond table to a supporting substrate. In an effort to provide cutting elements having diamond tables that are more thermally stable relative to non-leached diamond tables, but that are also relatively less brittle and vulnerable to shear, compressive, and tensile stresses relative to fully leached diamond tables, cutting elements have been provided that include a diamond table in which the catalyst material has been leached from a portion or portions of the diamond table. For example, it is known to leach catalyst material from the cutting face, from the side of the diamond table, or both, to a desired depth within the diamond table, but without leaching all of the catalyst material out from the diamond table.

BRIEF SUMMARY

In one embodiment, a cutting element may include a substrate and a volume of polycrystalline diamond material affixed to the substrate at an interface. The volume of polycrystalline diamond material may include a front cutting face with at least one substantially planar portion and at least one recess. The at least one recess may extend from a plane defined by the at least one substantially planar portion a first depth into the volume of polycrystalline diamond material in an axial direction parallel to a central axis of the cutting element. The volume of polycrystalline diamond material may include a region including a catalyst material disposed in interstitial spaces between diamond grains of the volume of polycrystalline diamond material, and the region including the catalyst material may extend through the volume of polycrystalline diamond material from the interface to an exposed surface of the volume of polycrystalline diamond material within the at least one recess of the front cutting face. The volume of polycrystalline diamond material may also include at least one region substantially free of the catalyst material. The at least one region substantially free of the catalyst material may extend from the at least one substantially planar portion of the front cutting face a second depth into the volume of polycrystalline diamond material in the axial direction.

In another embodiment, a cutting element may include a substrate and a volume of polycrystalline diamond material affixed to the substrate at an interface. The volume of polycrystalline diamond material may include a front cutting face with at least one substantially planar portion and at least one recess. The at least one recess may extend from a plane defined by the at least one substantially planar portion a first depth into the volume of polycrystalline diamond material in an axial direction parallel to a central axis of the cutting element. The volume of polycrystalline diamond may also include a region including a catalyst material disposed in interstitial spaces between diamond grains of the volume of polycrystalline diamond material, and at least one region substantially free of the catalyst material. The at least one region substantially free of the catalyst material may extend from the at least one substantially planar portion of the front cutting face a second depth into the volume of polycrystalline diamond material in the axial direction. The at least one region substantially free of the catalyst material may extend from a lowermost region of an exposed surface of the volume of polycrystalline diamond material within the at least one recess a third depth into the volume of polycrystalline diamond material in the axial direction.

In another embodiment, a method of fabricating a cutting element may include providing a volume of polycrystalline diamond material comprising diamond grains and a catalyst material disposed in interstitial spaces between the diamond grains. The volume of polycrystalline diamond material may include a front cutting face with at least one substantially planar portion and at least one recess. The recess may extend a first depth into the volume of polycrystalline diamond material in an axial direction parallel to a central axis of the cutting element. The method may also include forming at least one region substantially free of the catalyst material within the volume of polycrystalline diamond material. The region may extend from the at least one substantially planar portion of the front cutting face a second depth into the volume of polycrystalline diamond material in the axial direction, wherein the second depth is greater than the first depth.

BRIEF DESCRIPTION OF THE SEVERAL VIEWS OF THE DRAWINGS

While the specification concludes with claims particularly pointing out and distinctly claiming what are regarded as embodiments of the present invention, various features and advantages of disclosed embodiments may be more readily ascertained from the following description when read with reference to the accompanying drawings, in which:

DETAILED DESCRIPTION

The illustrations presented herein are not actual views of any particular material, cutting element, or earth-boring tool, but are merely idealized representations employed to describe embodiments of the present disclosure.

Figure 1:
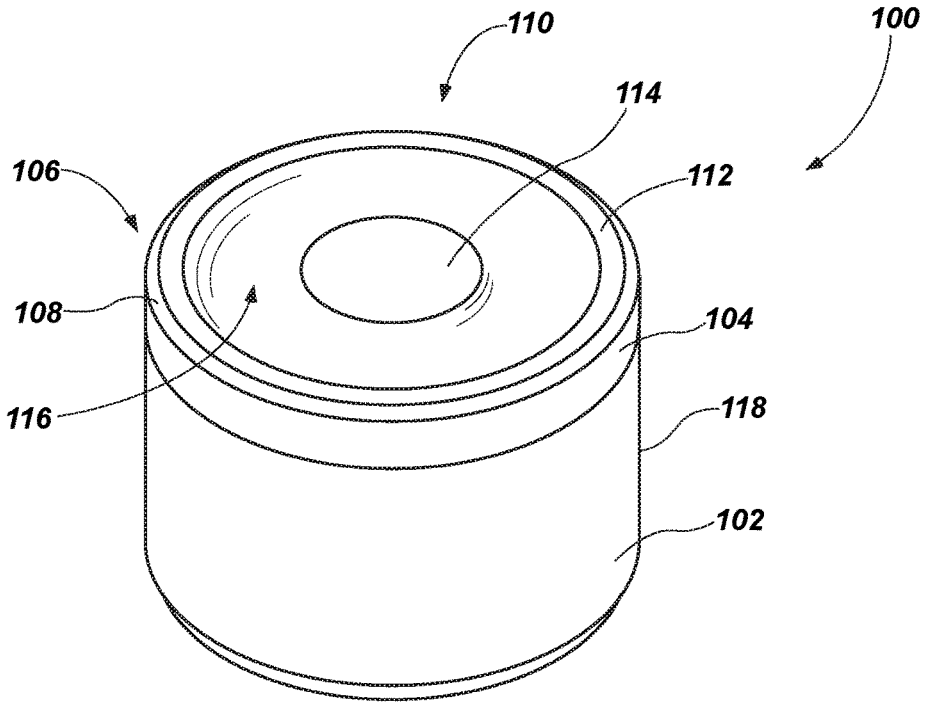
FIG. 1 is a perspective view of a cutting element.
Figure 2:
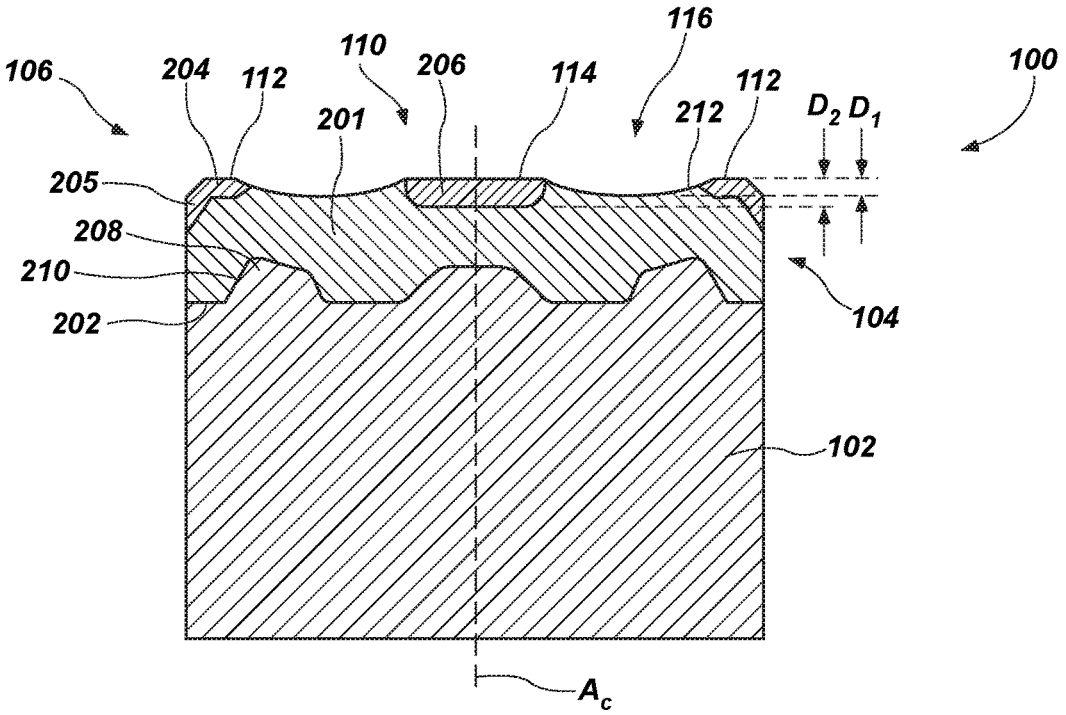
FIG. 2 is a cross-sectional side view of the cutting element of FIG. 1.

FIG. 1 is a perspective view of a cutting element 100. The cutting element 100 includes a cutting element substrate 102 and a volume of polycrystalline diamond material 104 affixed to the substrate 102. The volume of polycrystalline diamond material 104 may be formed on the cutting element substrate 102, or the volume of polycrystalline diamond material 104 and the substrate 102 may be formed separately and subsequently attached together. The cutting element 100 may have substantially cylindrical geometry, as shown in FIG. 1, with a lateral sidewall 118. The volume of polycrystalline diamond material 104 may have a front cutting face 110. As shown in FIGS. 1 and 2, a cutting edge 106, which may include one or more chamfered surfaces 108 oriented at any of various chamfer angles, may be formed between the front cutting face 110 and the lateral sidewall 118.

The front cutting face 110 may include one or more substantially planar portions. For example, in the embodiment of FIG. 1, the front cutting face 110 may include a substantially planar portion 112 with a generally annular shape disposed adjacent to and inward from the lateral sidewall 118 and cutting edge 106 of the cutting element 100. Additionally, a substantially planar portion 114 with a generally circular shape may be disposed in a substantially central location on the front cutting face 110.

The volume of polycrystalline diamond material 104 may also include a recess 116 formed in the front cutting face 110. In some embodiments, the recess 116 may be formed with a substantially annular geometry in a plane of the front cutting face 110. As a non-limiting example, the recess 116 may be formed substantially concentric with the generally cylindrical lateral sidewall 118, as shown in FIG. 1. In the embodiment of FIG. 1, the recess 116 may be formed in the front cutting face 110 of the cutting element 100 intermediate substantially planar portions 112 and 114. In other words, the volume of polycrystalline diamond material 104 may include a substantially planar front cutting face 110, into which is formed a recess 116. Thus, the substantially planar front cutting face 110 may include substantially planar, un-recessed portions, e.g., substantially planar portions 112 and 114, and at least one non-planar portion, e.g., recess 116.

As non-limiting examples, the front cutting face 110 may have any of the configurations described in U.S. Patent Publication No. 2013/0068538 A1, published on Mar. 21, 2013, in the name of DiGiovanni et al., U.S. Patent Publication No. 2013/0068534 A1, published on Mar. 21, 2013, in the name of DiGiovanni et al., and U.S. Patent Publication No. 2011/0259642 A1, published on Oct. 27, 2011, in the name of DiGiovanni et al., the disclosure of each of which is incorporated herein in its entirety by this reference.

The volume of polycrystalline diamond material 104 may include grains or crystals of diamond that are bonded directly together by inter-granular diamond-to-diamond bonds, as previously described. Interstitial regions or spaces between the diamond grains may be filled with additional materials, as discussed further below, or may be air-filled voids. The polycrystalline diamond material may be primarily comprised of diamond grains. For example, diamond grains may comprise at least about seventy percent (70%) by volume of the volume of the polycrystalline diamond material. In additional embodiments, the diamond grains may comprise at least about eighty percent (80%) by volume of the volume of polycrystalline diamond material, and in yet further embodiments, the diamond grains may comprise at least about ninety percent (90%) by volume of the volume of the polycrystalline diamond material.

The cutting element substrate 102 may be formed from a material that is relatively hard and resistant to wear. For example, the cutting element substrate 102 may be formed from and include a ceramic-metal composite material (which are often referred to as "cermet" materials). The cutting element substrate 102 may include a cemented carbide material, such as a cemented tungsten carbide material, in which tungsten carbide particles are cemented together in a metallic binder material. The metallic binder material may include, for example, cobalt, nickel, iron, or alloys and mixtures thereof.

Referring now to FIG. 2, the cutting element 100 of FIG. 1 is shown in a side cross-sectional view. The volume of polycrystalline diamond material 104 may include a region 201 comprising a catalyst material 304 (FIG. 3), as discussed in further detail below. The region 201 may extend through a portion of the volume of the polycrystalline diamond material 104, including a portion of the volume of polycrystalline diamond material adjacent an interface 202 between the volume of polycrystalline diamond material 104 and the cutting element substrate 102. In the embodiment shown in FIG. 2, the region 201 may extend through the volume of polycrystalline diamond material 104 to an exposed surface of the volume of polycrystalline diamond material 104 within the recess 116 in the front cutting face 110.

Figure 3:
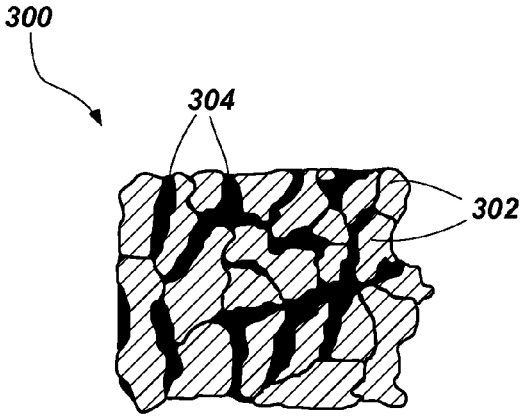
FIG. 3 is an enlarged view illustrating how a microstructure of an un-leached first region of a polycrystalline diamond material of the cutting element of FIGS. 1 and 2 may appear under magnification.

At least one region of the volume of polycrystalline diamond material 104 may be substantially free of the catalyst material 304 (FIG. 3). For example, the volume of polycrystalline diamond material 104 may include regions 204 and 206 substantially free of the catalyst material 304, as described in greater detail below in connection with FIG. 4.

The at least one region of the volume of polycrystalline diamond material 104 substantially free of the catalyst material 304 (FIG. 3) may extend from substantially planar portions of the front cutting face 110 into the volume of polycrystalline diamond material in an axial direction substantially parallel to a central axis $A_c$ of the cutting element 100. For example, the region 204 may extend from the planar portion 112 of the front cutting face 110 into the volume of polycrystalline diamond 104 in the direction substantially parallel to central axis $A_c$. The region 206 may extend from the planar portion 114 into the volume of polycrystalline diamond 104 in the direction substantially parallel to the central axis $A_c$. The region 201 including the catalyst material may extend from the interface 202 to at least a lower most region of an exposed surface of the volume of polycrystalline diamond material 104 within the recess 116 of the front cutting face 110. In the embodiment of FIG. 2, the portion of the region 201 extending to at least the lowermost region of the exposed surface of the volume of polycrystalline diamond 104 may be disposed between the regions 204 and 206 such that the regions 204 and 206 are discrete and separate from one another. In some embodiments, the regions 204 and 206 may extend partially beyond peripheral edges of the recess 116 at the surface of the front cutting face 110, as discussed in further detail below in connection with FIG. 8.

The recess 116 may have an arcuate shape in a cross-sectional plane normal to the plane of the front cutting face 110 (e.g., the cross-sectional plane of FIG. 2). For example, the recess 116 may have an arcuate shape 212 extending between the substantially planar portions 112 and 114. The arcuate shape 212 may have a substantially constant radius of curvature between the substantially planar portions 112 and 114. In some embodiments, the arcuate shape 212 may have a variable radius of curvature between the substantially planar portions 112 and 114. In yet other embodiments, the arcuate shape 212 may include multiple arcuate segments with differing radii. In some embodiments, the recess 116 may have a shape including one or more linear segments.

The recess 116 may extend a first depth $D_1$ from a plane defined by the substantially planar portions 112, 114 of the front cutting face 110 into the volume of polycrystalline diamond material 104 in the direction parallel to the central axis $A_c$ of the cutting element 100. As a non-limiting example, the first depth $D_1$ may extend from the plane of the substantially planar portions 112, 114 of the front cutting face 110 into the volume of polycrystalline diamond material 104 a depth of between about 0.0254 mm (0.001 inch)

and 2.54 mm (0.1 inch). In other embodiments, the first depth $D_1$ may be less than about 0.0254 mm or greater than about 2.54 mm.

The regions 204 and 206 substantially free of the catalyst material 304 (FIG. 3) may extend a second depth $D_2$ from the substantially planar portions 112, 114 of the front cutting face 110 into the volume of polycrystalline diamond material 104 in the direction parallel to the central axis $A_c$ of the cutting element 100. The second depth $D_2$ may be equal to or different from the first depth $D_1$. For example, as in the embodiment shown in FIG. 2, the second depth $D_2$ may exceed the first depth $D_1$. As a non-limiting example, the second depth $D_2$ may exceed the first depth $D_1$ by between about 0.0254 mm (0.001 inch) and 0.254 mm (0.01 inch). As a further non-limiting example, the second depth $D_2$ may be at least about ten percent (10%) greater than the first depth $D_1$.

In some embodiments, the region 204 may include a portion 205 proximate the cutting edge 106 (FIG. 1). The portion 205 may extend toward the cutting element substrate 102 through a portion of the volume of polycrystalline diamond 104 proximate the lateral sidewall 118 (FIG. 1) of the cutting element 100. Such a portion may be referred to in the art as a "barrel leach" or "annulus leach."

The interface 202 between the volume of polycrystalline diamond material 104 and the cutting element substrate 102 may have a planar or a non-planar shape. As one non-limiting example, the interface 202 may include a substantially annular protrusion 208 extending from the cutting element substrate 102 and a complementary annular recess 210 extending into the volume of polycrystalline diamond material 104. The interface geometry shown in FIG. 2 is provided simply as example interface geometry, and embodiments of the present disclosure may have any planar or non-planar geometry.

FIG. 3 is an enlarged view illustrating how a microstructure of a polycrystalline diamond material 300 in the first region 201 (FIG. 2) of the volume of polycrystalline diamond material 104 (FIGS. 1 and 2) may appear under magnification. As shown in FIG. 3, the first region 201 (FIG. 2) of the polycrystalline diamond material 300 includes diamond crystals or grains 302 that are bonded directly together by inter-granular diamond-to-diamond bonds to form the polycrystalline diamond material 300. A catalyst material 304 (the shaded regions between the diamond crystals or grains 302) is disposed in interstitial regions or spaces between the diamond grains 302. The catalyst material 304 may comprise, for example, a metal solvent catalyst material used in the formation of the inter-granular diamond-to-diamond bonds between the diamond grains 302.

As used herein, the term "catalyst material" refers to any material that is capable of catalyzing the formation of inter-granular diamond-to-diamond bonds in a diamond grit or powder during an HTHP process in the manufacture of polycrystalline diamond. By way of example, the catalyst material 302 may include cobalt, iron, nickel, or an alloy or mixture thereof, which catalyst materials are often referred to as "metal solvent catalyst materials." The catalyst material 302 may comprise other than elements from Group VIIIA of the Periodic Table of the Elements.

Figure 4:
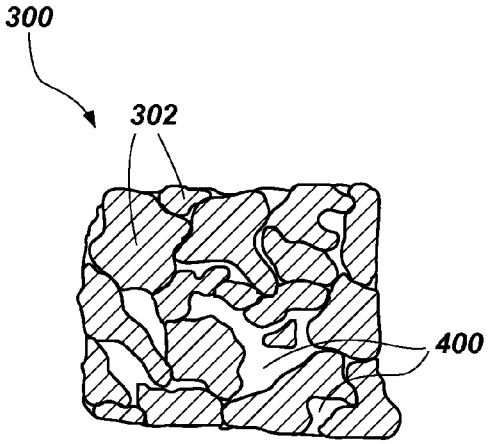
FIG. 4 is an enlarged view illustrating how a microstructure of a leached second region of the polycrystalline diamond material of the cutting element of FIGS. 1 and 2 may appear under magnification.

FIG. 4 is an enlarged view like that of FIG. 3 illustrating how a microstructure of the polycrystalline diamond material 300 in the regions 204 and 206 (FIG. 2) may appear under magnification. As shown in FIG. 4, the regions 204 and 206 of the polycrystalline diamond material 300 also include diamond crystals or grains 302 that are bonded directly together by inter-granular diamond-to-diamond bonds to form the polycrystalline diamond material 300. In the regions 204 and 206, however, interstitial spaces 400 between the diamond crystals or grains 302 may comprise voids (i.e., they may be filled with gas, such as air), or they may comprise a material that is not a catalyst material. In some embodiments, the interstitial spaces may be substantially filled with a replacement material. By way of example and not limitation, such a replacement material may comprise silicon carbide.

The polycrystalline diamond material 300 (FIG. 3) of the region 201 (FIG. 2) may comprise what is often referred to in the art as an "un-leached" region, and polycrystalline diamond material 300 (FIG. 4) of the regions 204 and 206 (FIG. 2) may comprise what is often referred to in the art as a "leached" region. Embodiments of cutting elements as described herein, such as the cutting element 100, may be formed by using a leaching process to remove the catalyst material 304 from the regions 204 and 206 without removing catalyst material 304 from the region 201, as described below with reference to FIG. 8. In other embodiments, however, other non-leaching methods may be used to remove the catalyst material 304 from the regions 204 and 206 of the polycrystalline diamond material 300, or the polycrystalline diamond material 300 may simply be formed in a manner that results in the presence of catalyst material 304 within the region 201 and an absence of catalyst material 304 in the regions 204 and 206, such that removal of catalyst material 304 from the regions 204 and 206 is not needed or required. Thus, as used herein, the term "leached," when used in relation to a region of a volume of polycrystalline diamond, means a region that does not include catalyst material in interstitial spaces between inter-bonded diamond grains, regardless of whether or not catalyst material was removed from that region (by a leaching process or any other removal process). Similarly, as used herein, the term "un-leached," when used in relation to a region of a volume of polycrystalline diamond, means a region that includes catalyst material in interstitial spaces between inter-bonded diamond grains (regardless of whether or not catalyst material was leached or otherwise removed from other regions of the polycrystalline diamond).

Figure 5:
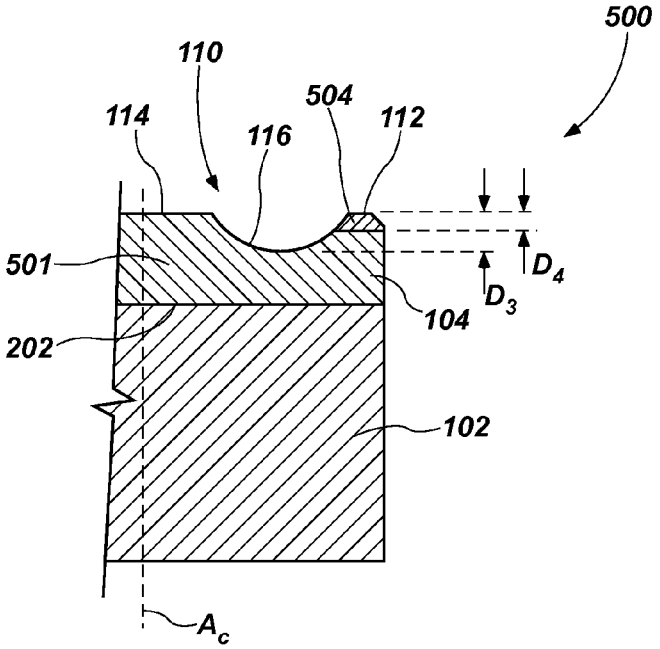
FIG. 5 is a cross-sectional side view illustrating another embodiment of a cutting element.

Referring now to FIG. 5, another embodiment of a cutting element 500 is shown. In the embodiment of FIG. 5, the cutting element 500 includes a cutting element substrate 102 and a volume of polycrystalline diamond material 104 affixed together at an interface 202. The volume of polycrystalline diamond material 104 may include a front cutting face 110 with a recess 116 formed therein and substantially planar portions 112 and 114. The recess 116 may extend from a plane defined by the substantially planar portions 112 and 114 of the front cutting face 110 a depth $D_3$ into the volume of polycrystalline diamond material 104 in a direction parallel to a central axis $A_c$ of the cutting element 500. A leached portion 504 may extend from only the substantially planar portion of 112 of the front cutting face 110 and may extend a depth $D_4$ into the volume of polycrystalline diamond material 104 in a direction parallel to a central axis $A_c$ of the cutting element 500. Thus, an unleached portion 501 may extend from the interface 202 to the substantially planar portion 114 of the volume of polycrystalline diamond material 104. In the embodiment of FIG. 5, the depth $D_3$ of the recess 116 may exceed the depth $D_4$ of the leached portion 502. As a non-limiting example, the depth $D_3$ of the recess may be at least about ten percent (10%) greater than depth $D_4$ of the leached portion 502.

Figure 6:
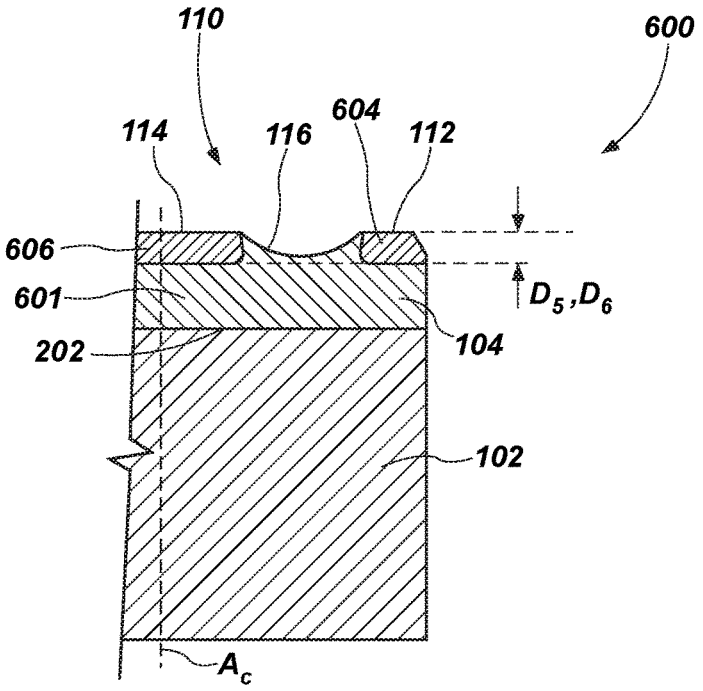
FIG. 6 is a cross-sectional side view illustrating another embodiment of a cutting element.

FIG. 6 is a side cross-sectional view of another embodiment of a cutting element 600 according to the disclosure.

The cutting element 600 may include a recess 116 formed in a front cutting face 110 of a volume of polycrystalline diamond material 104. The recess 116 may extend from a plane defined by substantially planar portions 112 and 114 a depth $D_5$ into the volume of polycrystalline diamond material 104 in a direction parallel to a central axis $A_c$ of the cutting element 600. An unleached portion 601 may extend from an interface 202 between the cutting element substrate 102 and the volume of polycrystalline diamond material 104 to an exposed surface of the volume of polycrystalline diamond material 104 within the recess 116. Leached portions 604 and 606 may extend respectively from substantially planar portions 112 and 114 of the front cutting face 110 a depth $D_6$ into the volume of polycrystalline diamond material 104 in the direction parallel to the central axis $A_c$ of the cutting element 600. In this embodiment, the depth $D_5$ and the depth $D_6$ may be substantially equal.

Figure 7:
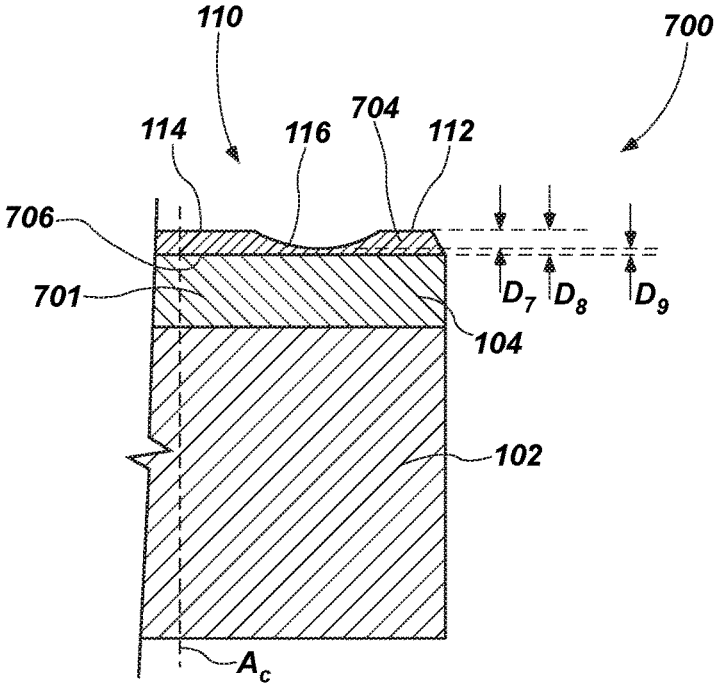
FIG. 7 is a cross-sectional side view illustrating another embodiment of a cutting element.

Referring now to FIG. 7, a cutting element 700 may include a volume of polycrystalline diamond material 104 affixed to a cutting element substrate 102. The volume of polycrystalline diamond material 104 may include a front cutting face 110 including substantially planar portions 112 and 114 and a recess 116. The recess 116 may extend into the volume of polycrystalline diamond material 104 a depth $D_7$ in a direction parallel to a central axis $A_c$ of the cutting element 700. A leached region 704 may extend from the substantially planar surfaces 112 and 114 of the front cutting face 110 a depth $D_8$ into the volume of polycrystalline diamond material 104 in the direction parallel to the central axis $A_c$. The leached region 704 may also extend from a lowermost region of an exposed surface of the volume of polycrystalline diamond material 104 within the recess 116 a depth $D_9$ into the volume of polycrystalline diamond material 104 in the direction parallel to the central axis $A_c$. Depth $D_9$ may be less than depth $D_8$. In the embodiment shown in FIG. 7, the sum of depths $D_8$ and $D_9$ may be substantially equal to depth $D_7$.

The leached region 704 may extend substantially continuously over a surface of the volume of polycrystalline diamond material 104 defined by the front cutting face 110. The leached region 704 may extend from a plane defined by the substantially planar portions 112 and 114 of the front cutting face 110 into the volume of polycrystalline diamond material 104 a substantially uniform depth, e.g., depth $D_8$ shown in FIG. 7, in the direction parallel to the central axis $A_c$.

Thus, the leached region 704 may meet an unleached region 701 at a substantially planar boundary 706 within the volume of polycrystalline diamond material 104. The substantially planar boundary 706 may extend substantially continuously through the volume of polycrystalline diamond 104. In some embodiments, as shown in FIG. 7, the substantially planar boundary 706 may extend substantially normal to the central axis $A_c$.

In other embodiments, the leached region 704 may meet the unleached region 701 at a non-planar boundary within the volume of polycrystalline diamond material 104, or a boundary including planar portions and non-planar portions within the volume of polycrystalline diamond material 104.

Figure 8:
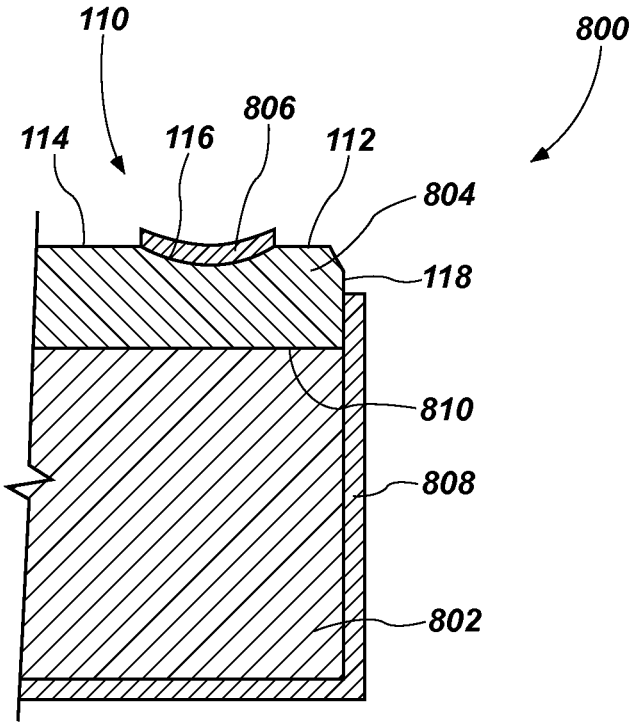
FIG. 8 is a cross-sectional side view illustrating a method that may be used to form cutting elements of the disclosure.

FIG. 8 is a cross-sectional side view similar to that of FIGS. 2 and 5 through 7, and illustrates a cutting element 800 including a volume of polycrystalline diamond material 804 affixed to a cutting element substrate 802. The volume of polycrystalline diamond material 804 and the substrate 802 may be as previously described herein, with the exception that the polycrystalline diamond material 300 (FIG. 3) may be initially un-leached, such that the entirety of the volume of polycrystalline diamond material 804 includes the catalyst material 304 (FIG. 3) in the interstitial spaces between the inter-bonded diamond grains 302 (FIG. 3) of the polycrystalline diamond material 300. Thus, the entire volume of polycrystalline diamond material 804 may initially be like the un-leached first region 201 of the volume of polycrystalline diamond material 104 of cutting element 100 of FIG. 2.

As shown in FIG. 8, a mask may be formed or otherwise provided over exterior surfaces of the cutting element 800. For example, the mask may include a mask portion 806 substantially covering an exposed surface of the volume of polycrystalline diamond material 804 within a recess 116 formed in a front cutting face 110. While the mask portion 806 is shown in FIG. 8 substantially covering the exposed surface of the volume of polycrystalline diamond material 804 within the recess 116, the mask portion 806 may cover less than the entire exposed surface within the recess 116. The mask portion 806 may or may not cover substantially planar portions 112 and 114 of the front cutting face 110. The mask may include another portion 808 that covers the exterior surfaces of the substrate 802, and may extend over and cover an interface 810 between the substrate 802 and the volume of polycrystalline diamond material 804. In some embodiments, the mask portion 808 may leave a portion of the lateral side wall 118 of the volume of polycrystalline diamond material 804 exposed.

The mask portions 806 and 808 may comprise a layer of material that is impermeable to a leaching agent used to leach catalyst material 304 out from the interstitial spaces between the diamond grains 302 within what will become a leached region within the polycrystalline diamond material 300 (FIG. 3) of the volume of polycrystalline diamond material 804. As a non-limiting example, the mask portions 806 and 808 may comprise a polymer material, such as an epoxy.

After forming or otherwise providing the mask portions 806 and 808 on the cutting element 800, the volume of polycrystalline diamond material 804 including the cutting face 110 may then be immersed in or otherwise exposed to a leaching agent (e.g., an acid, aqua regia, etc.), such that the leaching agent may be allowed to leach and remove the catalyst material 304 (e.g., metal solvent catalyst) out from the interstitial spaces between the diamond grains 302 (FIG. 3) within the volume of polycrystalline diamond material 804, thus forming leached regions 204 and 206 (FIG. 2), 504 (FIG. 5), 604 and 606 (FIG. 6), or 704 (FIG. 7). Furthermore, the leaching agent may remove the catalyst material from the portion of the lateral side wall 118 exposed by the mask portion 808 to form an annulus leach (e.g., barrel leach) 205 (FIG. 2).

A particular depth of a leached region, e.g., depth $D_2$ (FIG. 2), $D_4$ (FIG. 5), $D_6$ (FIG. 6), or $D_8$ (FIG. 7) may be achieved by exposing the volume of polycrystalline diamond material 804 to the leaching agent for a selected period of time. For example, exposing the volume of polycrystalline diamond material 804 to the leaching agent for a relatively greater time may result in a relatively greater leach depth. Conversely, exposing the volume of polycrystalline diamond material 804 to the leaching agent for a relatively shorter time may result in a relatively shallower leach depth.

Because the mask portion 806, 808 only covers the surface of the volume of polycrystalline diamond material 804, the leaching agent may diffuse into and through interstitial spaces between diamond grains of the polycrystalline diamond material 804 from behind the mask. Thus, the geometrical boundaries of the leached regions may not be precisely coextensive with the unmasked areas, e.g., regions 204 and 206 (FIG. 2) through the entire depth of the leached regions. For example, the leached regions 204 and 206 may extend beyond peripheral edges of the mask portions 806, 808 to some extent as the leaching agent diffuses into the volume of polycrystalline diamond material 804 behind the mask portions 806, 808.

After exposing the volume of polycrystalline diamond material 804 and the mask portions 806, 808 to the leaching agent for the desired time to form one or more leached regions, the mask portions 806, 808 may be removed from the cutting element 800 and the cutting element 800 may be used on an earth-boring tool.

A cutting element 100, 500, or 600 as previously described with reference to FIGS. 1, 2, 5, and 6 may be formed in a similar manner to that described in relation to cutting element 900.

In some embodiments, portions of the cutting element 800 may be reintroduced to the leaching agent following removal of the mask portions 806 and 808. For example, a cutting element similar to cutting element 700 (FIG. 7) may be formed by masking the cutting element 800 as described above and exposing the masked cutting element 800 to a leaching agent for a period of time sufficient to create leached regions having an initial leach depth. The cutting element 800 may then be removed from exposure to the leaching agent, and all or a portion of the masking material 806, 808 may be removed from the volume of polycrystalline diamond material 804. For example, a portion of the masking material 806 may be removed from the recess 116. The polycrystalline diamond material 804 may then be re-exposed to the leaching agent for a time sufficient to form a leached region having the desired depth in a previously masked portion of the volume of polycrystalline diamond material 804. The leaching agent may also enter previously leached regions having the initial leach depth and diffuse further into the volume of polycrystalline diamond material, removing additional catalyst material and forming leached regions having a final leach depth greater than the initial leach depth.

Embodiments of cutting elements of the present disclosure, such as the cutting elements 100, 500, 600, and 700 as previously described herein with reference to FIGS. 1, 2, and 5 through 7 may exhibit reduced fracture and spalling and, hence, increase useable lifetimes relative to previously known cutting elements. For example, the unleached regions 201 (FIG. 2), 501 (FIG. 5), 601 (FIG. 6), and 701 (FIG. 7) may exhibit improved thermal conductivity and toughness relative to the leached regions 204 and 206 (FIG. 2), 504 (FIG. 5), 604 and 606 (FIG. 6), or 704 (FIG. 7), and the configurations of the leached regions and the unleached regions as described herein may contribute to selectively increased compressive stresses in portions of the polycrystalline diamond material and overall improved stress distributions within the volume of polycrystalline diamond material 104.

Embodiments of cutting elements of the present disclosure, such as the cutting elements 100, 500, 600, and 700 as previously described herein with reference to FIGS. 1, 2, and 5 through 7 may be used to form embodiments of earth-boring tools of the disclosure.

Figure 9:
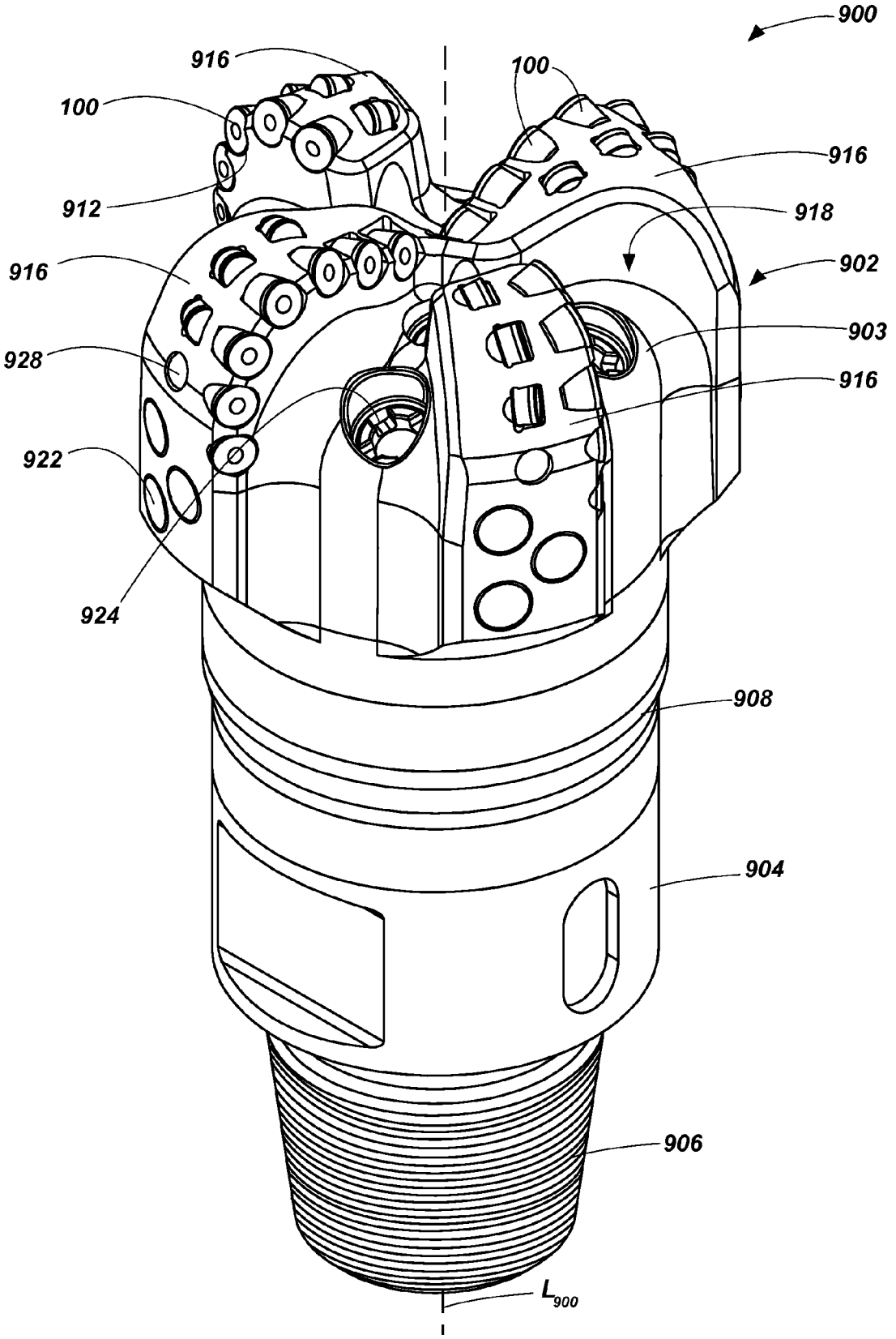
FIG. 9 is a perspective view of an embodiment of an earth-boring tool in the form of a fixed-cutter earth-boring rotary drill bit, which may include a plurality of cutting elements like that shown in FIGS. 1 and 2 or those shown in FIGS. 5 through 7.

FIG. 9 is a perspective view of an embodiment of an earth-boring rotary drill bit 900 of the present disclosure that includes a plurality of cutting elements 100 like those shown in FIGS. 1 and 2, although the drill bit 900 may include cutting elements 500, 600, 700, or any other cutting elements according to the present disclosure in additional embodiments. The earth-boring rotary drill bit 900 includes a bit body 902 that is secured to a shank 904 having a threaded connection portion 906 (e.g., an American Petroleum Institute (API) threaded connection portion) for attaching the drill bit 900 to a drill string (not shown). In some embodiments, such as that shown in FIG. 9, the bit body 902 may comprise a particle-matrix composite material, and may be secured to the metal shank 904 using an extension 908. In other embodiments, the bit body 902 may be secured to the shank 904 using a metal blank embedded within the particle-matrix composite bit body 902, or the bit body 902 may be secured directly to the shank 904.

The bit body 902 may include internal fluid passageways (not shown) that extend between a face 903 of the bit body 902 and a longitudinal bore (not shown), which extends through the shank 904, the extension 908, and partially through the bit body 902. Nozzle inserts 924 also may be provided at the face 903 of the bit body 902 within the internal fluid passageways. The bit body 902 may further include a plurality of blades 916 that are separated by junk slots 918. In some embodiments, the bit body 902 may include gage wear plugs 922 and wear knots 928. A plurality of cutting elements 100 as previously disclosed herein (FIGS. 1 and 2) may be mounted on the face 903 of the bit body 902 in cutting element pockets 912 that are located along each of the blades 916. In other embodiments, cutting elements 500, 600, or 700 like those shown in FIGS. 5 through 7, or any other embodiment of a cutting element as disclosed herein may be provided in the cutting element pockets 912.

The cutting elements 100 are positioned to cut a subterranean formation being drilled while the drill bit 900 is rotated under weight-on-bit (WOB) in a bore hole about centerline $L_{900}$.

The cutting elements 100, 500, 600, and 700 described herein, or any other cutting elements according to the present disclosure, may be used on other types of earth-boring tools. As non-limiting examples, embodiments of cutting elements of the present disclosure also may be used on cones of roller cone drill bits, on reamers, mills, bi-center bits, eccentric bits, coring bits, and so-called "hybrid bits" that include both fixed cutters and rolling cutters.

Additional non-limiting example embodiments of the disclosure are set forth below.

Embodiment 1

A cutting element, comprising: a substrate; and a volume of polycrystalline diamond material affixed to the substrate at an interface, the volume of polycrystalline diamond material comprising: a front cutting face with at least one substantially planar portion and at least one recess, the at least one recess extending from a plane defined by the at least one substantially planar portion a first depth into the volume of polycrystalline diamond material in an axial direction parallel to a central axis of the cutting element; a region including a catalyst material disposed in interstitial spaces between diamond grains of the volume of polycrystalline diamond material, the region including the catalyst material extending through the volume of polycrystalline diamond material from the interface to an exposed surface of the volume of polycrystalline diamond material within the at least one recess of the front cutting face; and at least one region substantially free of the catalyst material, wherein the at least one region substantially free of the catalyst material extends from the at least one substantially planar portion of the front cutting face a second depth into the volume of polycrystalline diamond material in the axial direction.

Embodiment 2

The cutting element of Embodiment 1, wherein the at least one region substantially free of the catalyst material comprises two discrete regions substantially free of the catalyst material, and wherein the region including the catalyst material is disposed at least partially between the two discrete regions substantially free of the catalyst material.

Embodiment 3

The cutting element of Embodiment 2, wherein the at least one substantially planar portion of the front cutting face comprises two discrete substantially planar portions, and wherein each of the two discrete regions substantially free of the catalyst material extends from a respective one of the two discrete substantially planar portions of the front cutting face the second depth into the volume of polycrystalline diamond material in the axial direction.

Embodiment 4

The cutting element of any one of Embodiments 1 through 3, wherein the at least one region substantially free of the catalyst material extends to an exposed surface of the volume of polycrystalline diamond material proximate a cutting edge formed between the front cutting face and a generally cylindrical lateral side surface of the cutting element.

Embodiment 5

The cutting element of any one of Embodiments 1 through 5, wherein the second depth is less than the first depth.

Embodiment 6

The cutting element of any one of Embodiments 1 through 5, wherein the second depth is substantially equal to the first depth.

Embodiment 7

The cutting element of any one of Embodiments 1 through 5, wherein the second depth is greater than the first depth.

Embodiment 8

The cutting element of Embodiment 7, wherein the second depth is at least about ten percent (10%) greater than the first depth.

Embodiment 9

The cutting element of Embodiment 7 or 8, wherein the second depth is greater than the first depth by at least about 0.0254 mm (0.001 inch).

Embodiment 10

An earth-boring tool, comprising: a body; and the cutting element of any one of Embodiments 1 through 9 affixed to the body.

Embodiment 11

The earth-boring tool of Embodiment 10, wherein the earth-boring tool is a fixed-cutter drill bit.

Embodiment 12

A cutting element, comprising: a substrate; and a volume of polycrystalline diamond material affixed to the substrate at an interface, the volume of polycrystalline diamond material comprising: a front cutting face with at least one substantially planar portion and at least one recess, the at least one recess extending from a plane defined by the at least one substantially planar portion a first depth into the volume of polycrystalline diamond material in an axial direction parallel to a central axis of the cutting element; a region including a catalyst material disposed in interstitial spaces between diamond grains of the volume of polycrystalline diamond material; and at least one region substantially free of the catalyst material, wherein the at least one region substantially free of the catalyst material extends from the at least one substantially planar portion of the front cutting face a second depth into the volume of polycrystalline diamond material in the axial direction, and wherein the at least one region substantially free of the catalyst material extends from a lowermost region of an exposed surface of the volume of polycrystalline diamond material within the at least one recess a third depth into the volume of polycrystalline diamond material in the axial direction.

Embodiment 13

The cutting element of Embodiment 12, wherein the third depth is less than the second depth.

Embodiment 14

The cutting element of Embodiment 12 or 13, wherein the at least one region substantially free of catalyst material extends substantially continuously over a surface of the volume of polycrystalline diamond material defined by the front cutting face.

Embodiment 15

The cutting element of Embodiment 14, wherein the at least one region substantially free of catalyst material and the region including the catalyst material meet at a substantially planar boundary extending substantially continuously through the volume of polycrystalline diamond material.

Embodiment 16

The cutting element of Embodiment 15, wherein the substantially planar boundary extends normal to the axial direction.

Embodiment 17

An earth-boring tool, comprising: a body; and the cutting element of any one of Embodiments 12 through 16 affixed to the body.

Embodiment 18

A method of fabricating a cutting element, comprising: providing a volume of polycrystalline diamond material comprising diamond grains and a catalyst material disposed in interstitial spaces between the diamond grains, the volume of polycrystalline diamond material comprising a front cutting face with at least one substantially planar portion and at least one recess, the at least one recess extending a first depth into the volume of polycrystalline diamond material in an axial direction parallel to a central axis of the cutting element; and forming at least one region substantially free of the catalyst material within the volume of polycrystalline diamond material, the region extending from the at least one substantially planar portion of the front cutting face a second depth into the volume of polycrystalline diamond material in the axial direction, wherein the second depth is greater than the first depth.

Embodiment 19

The method of Embodiment 18, wherein removing the catalyst material from a region of the volume of polycrystalline diamond material comprises: applying a mask material resistant to a leaching agent to a surface of the volume of polycrystalline diamond material within the at least one recess of the front cutting face; and introducing at least a portion of the volume of polycrystalline diamond material and the mask material to the leaching agent.

Embodiment 20

The method of Embodiment 19, further comprising removing at least a portion of the mask material from the at least one recess and subsequently reintroducing at least a portion of the previously masked portion of the volume of polycrystalline diamond material to the leaching agent.

Although the foregoing description contains many specifics, these are not to be construed as limiting the scope of the present invention, but merely as providing certain exemplary embodiments. Similarly, other embodiments of the invention may be devised that do not depart from the spirit or scope of the present disclosure. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the disclosed embodiments, which fall within the meaning and scope of the claims, are encompassed by the present disclosure.

What is claimed is:

1. A cutting element, comprising:

a substrate; and a volume of polycrystalline diamond material affixed to the substrate at an interface, the volume of polycrystalline diamond material comprising:

a front cutting face comprising:

a first substantially planar portion located adjacent to a lateral side surface of the cutting element;

a second, discrete substantially planar portion located in a central region of the front cutting face; and at least one recess located at least partially between the first and second substantially planar portions, the at least one recess extending from a plane defined by the first and second substantially planar portions to a first depth in the volume of polycrystalline diamond material in an axial direction parallel to a central axis of the cutting element;

a region including a catalyst material disposed in interstitial spaces between diamond grains of the volume of polycrystalline diamond material, the region including the catalyst material extending through the volume of polycrystalline diamond material from the interface to an exposed surface of the volume of polycrystalline diamond material within the at least one recess of the front cutting face; and a first region substantially free of the catalyst material, wherein the first region substantially free of the catalyst material extends from the first substantially planar portion of the front cutting face to a second depth in the volume of polycrystalline diamond material in the axial direction; and a second region substantially free of the catalyst material, wherein the second region substantially free of the catalyst material extends from the second substantially planar portion of the front cutting face to a third depth in the volume of polycrystalline diamond material in the axial direction, the second region substantially free of the catalyst material discrete from and separated from the first region substantially free of the catalyst material by the region including catalyst material, wherein the second depth and the third depth are greater than the first depth.

2. The cutting element of claim 1, wherein the first region substantially free of the catalyst material extends to an exposed surface of the volume of polycrystalline diamond material proximate a cutting edge formed between the front cutting face and a generally cylindrical lateral side surface of the cutting element.

3. The cutting element of claim 1, wherein the second depth and the third depth are substantially equal.

4. The cutting element of claim 1, wherein the second depth is at least about ten percent (10%) greater than the first depth.

5. The cutting element of claim 1, wherein the second depth is greater than the first depth by at least about 0.0254 mm (0.001 inch).

6. The cutting element of claim 1, wherein the third depth is less than the second depth.

7. An earth-boring tool, comprising:

a body; and the cutting element of claim 1 affixed to the body.

8. The earth-boring tool of claim 7, wherein the earth-boring tool is a fixed-cutter drill bit.

9. A cutting element, comprising:

a substrate; and a volume of polycrystalline diamond material affixed to the substrate at an interface, the volume of polycrystalline diamond material comprising:

a front cutting face with at least one substantially planar portion and at least one recess, the at least one recess extending from a plane defined by the at least one substantially planar portion a first depth into the volume of polycrystalline diamond material in an axial direction parallel to a central axis of the cutting element;

a region including a catalyst material disposed in interstitial spaces between diamond grains of the volume of polycrystalline diamond material; and at least one region substantially free of the catalyst material, wherein the at least one region substantially free of the catalyst material extends from the at least one substantially planar portion of the front cutting face a second depth into the volume of polycrystalline diamond material in the axial direction, and wherein the at least one region substantially free of the catalyst material extends from a lowermost region of an exposed surface of the volume of polycrystalline diamond material within the at least one recess a third depth into the volume of polycrystalline diamond material in the axial direction, wherein the second depth and the third depth are greater than the first depth.

10. The cutting element of claim 9, wherein the third depth is less than the second depth.

11. The cutting element of claim 9, wherein the at least one region substantially free of catalyst material extends substantially continuously over a surface of the volume of polycrystalline diamond material defined by the front cutting face.

12. The cutting element of claim 11, wherein the at least one region substantially free of catalyst material and the region including the catalyst material meet at a substantially planar boundary extending substantially continuously through the volume of polycrystalline diamond material.

13. The cutting element of claim 12, wherein the substantially planar boundary extends normal to the axial direction.

14. An earth-boring tool, comprising:

a body; and the cutting element of claim 9 affixed to the body.

15. A method of fabricating a cutting element, comprising:

affixing a volume of polycrystalline diamond material to a substrate at an interface, the volume of polycrystalline diamond material comprising:

diamond grains and a catalyst material disposed in interstitial spaces between the diamond grains;

a front cutting face comprising:

a first substantially planar portion located adjacent to a lateral side surface of the cutting element;

a second, discrete substantially planar portion located in a central region of the front cutting face; and at least one recess located at least partially between the first and second substantially planar portions, the at least one recess extending from a plane defined by the first and second substantially planar portions to a first depth in the volume of polycrystalline diamond material in an axial direction parallel to a central axis of the cutting element; and a region including the catalyst material extending through the volume of polycrystalline diamond material from the interface to an exposed surface of the volume of polycrystalline diamond material within the at least one recess of the front cutting face; and forming a first region substantially free of the catalyst material within the volume of polycrystalline diamond material, the at least one region extending from the first substantially planar portion of the front cutting face to a second depth in the volume of polycrystalline diamond material in the axial direction, wherein the second depth is greater than the first depth; and forming a second region substantially free of the catalyst material within the volume of polycrystalline diamond material, wherein the second region substantially free of the catalyst material extends from the second substantially planar portion of the front cutting face to a third depth in the volume of polycrystalline diamond material in the axial direction, the second region substantially free of the catalyst material discrete from and separated from the first region substantially free of the catalyst material by the region including catalyst material, wherein the second depth and the third depth are greater than the first depth.

16. The method of claim 15, wherein forming at least one region substantially free of catalyst material within the volume of polycrystalline diamond material comprises:

applying a mask material resistant to a leaching agent to a surface of the volume of polycrystalline diamond material within the at least one recess of the front cutting face; and introducing at least a portion of the volume of polycrystalline diamond material and the mask material to the leaching agent.

17. The method of claim 16, further comprising removing at least a portion of the mask material from the at least one recess and subsequently reintroducing at least a portion of the previously masked portion of the volume of polycrystalline diamond material to the leaching agent.

* * * * *